United States Patent [19]

Farge

[11] 4,183,185

[45] Jan. 15, 1980

[54] PREFABRICATED MODULAR BUILDING

[75] Inventor: Herve Farge, Maurepas, France

[73] Assignee: A.C.R.E.T.-Atelier du Centre de Recherche Etudes et Travaux, Levasville, France

[21] Appl. No.: 884,013

[22] Filed: Mar. 6, 1978

[30] Foreign Application Priority Data

Mar. 10, 1977 [FR] France ..... 77 07050

[51] Int. Cl.[2] ..... E04B 1/00

[52] U.S. Cl. ..... 52/79.13; 52/270; 52/280; 52/287; 52/295; 52/475; 52/656; 52/698

[58] Field of Search ..... 52/79.1, 79.9–79.13, 52/270, 252, 254, 280, 288, 295, 475, 656, 698, 701, 245, 247, 272, 275, 285, 73, 287

[56] References Cited

FOREIGN PATENT DOCUMENTS

| | | |
|---|---|---|
| 1329921 | 5/1963 | France . |
| 2181572 | 12/1973 | France . |
| 2238818 | 2/1975 | France . |
| 2263358 | 10/1975 | France . |

*Primary Examiner*—J. Karl Bell

*Attorney, Agent, or Firm*—Frishauf, Holtz, Goodman & Woodward

[57] ABSTRACT

The present invention relates to a prefabricated modular building composed of a roof, a floor and vertical panels assembled together, said building further comprising four vertical corner elements placed respectively at the four corners of the building, extending over the whole height of the vertical panels and forming ties between the roof and the floor, and vertical securing members anchored, at one of their ends, in one of the horizontal elements (roof or floor), passing through each corner element and blocked, at their other ends, in the other horizontal element (floor or roof).

8 Claims, 7 Drawing Figures

PREFABRICATED MODULAR BUILDING

BACKGROUND OF THE INVENTION

The present invention relates to a prefabricated modular building composed of a roof, a floor and vertical panels assembled together.

Buildings of this type are already known which are used, for example, to provide temporary accommodation on various sites, making available sanitary equipment, rest rooms, canteens, as well as offices, laboratories, workshops, etc. . . Heretofore known buildings of this type are not designed to have a long life and, after they have been used a few times at different spots, requiring dismantling and re-assembly operations, they generally prove to be unsuitable for subsequent use. Furthermore, their comfort is scanty and aesthetic qualities mediocre.

SUMMARY OF THE INVENTION

The present invention intends to remedy these drawbacks by providing a robust building which is economical to manufacture, easy to assemble and dismantle, and able to be used a large number of times without its intrinsic features of comfort and solidity being altered.

To this end, this prefabricated modular building, generally parallelepipedic in form, comprising a roof, a floor and vertical panels, as well as means for assembling these various elements together, further comprises four vertical corner elements extending over the whole height of the vertical panels and forming ties between the roof and the floor, and vertical securing members anchored, at one of their ends, in one of the horizontal elements (roof or floor), passing vertically through each corner element and held tensioned, at their other ends, in the other horizontal element (floor or roof).

All the elements constituting the building according to the invention are advantageously made of moulded plastic material. Due to the provision of ribs judiciously placed on the roof and the floor, these elements of the building are extremely rigid and allow the assembled building to be transported.

To obtain this rigidity, the floor is provided with at least two downwardly projecting longitudinal ribs, also called "skids", upwardly open and there suitable for housing pipes and, in the body of the material constituting the floor, two transverse tunnels allowing the whole of the building to be handled and transported by means of a fork-lift truck.

The roof, also made of moulded plastic material, is provided along its edges with ribs which define with one another a central recessed part collecting the rain water which is canalised towards channels opening out at right angles to guttering provided in the corners or ends of the building.

BRIEF DESCRIPTION OF THE DRAWINGS

The invention will be more readily understood on reading the following description with reference to the accompanying drawings, in which.

DESCRIPTION OF THE PREFERRED EMBODIMENT

Figure 1:
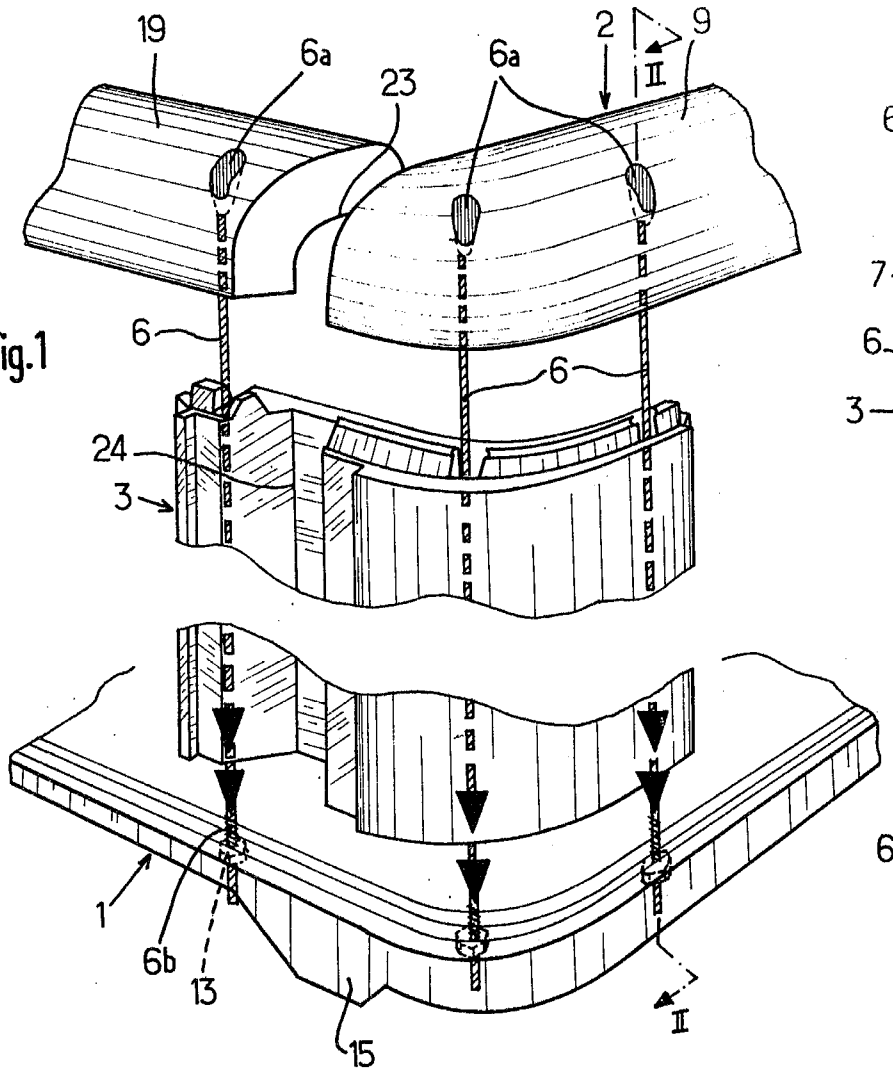
FIG. 1 is an exploded view in perspective, with parts torn away, of a corner of the prefabricated modular building according to the invention.
Figure 3:
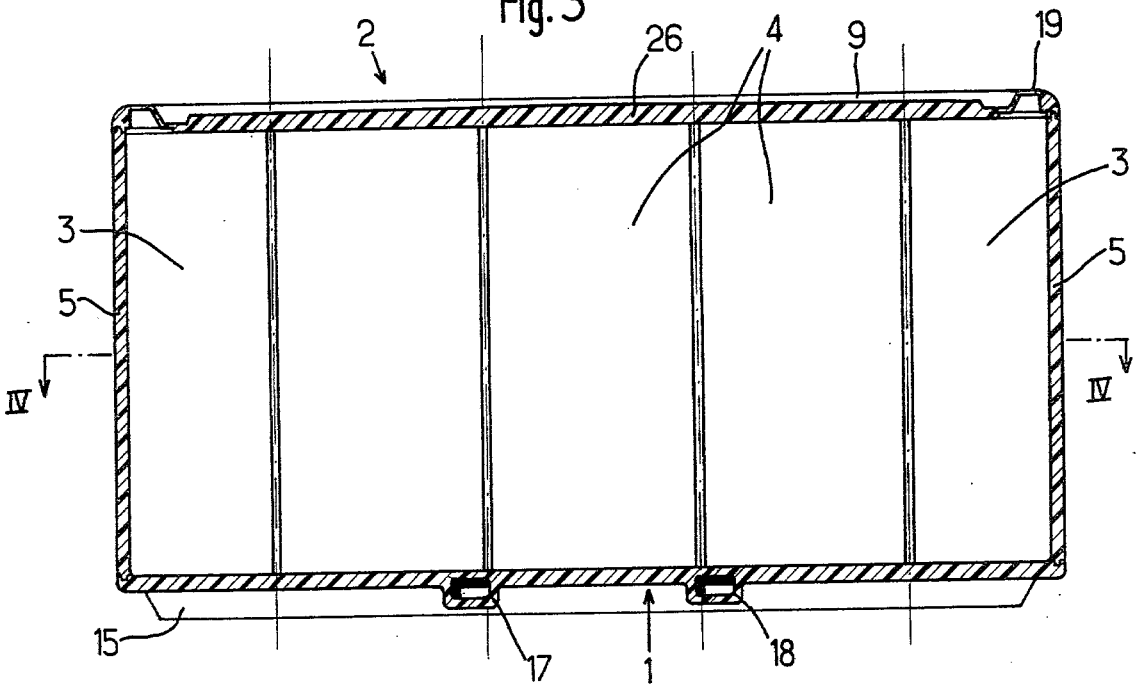
FIG. 3 is a vertical and longitudinal section of the whole of the building according to the invention.
Figure 4:
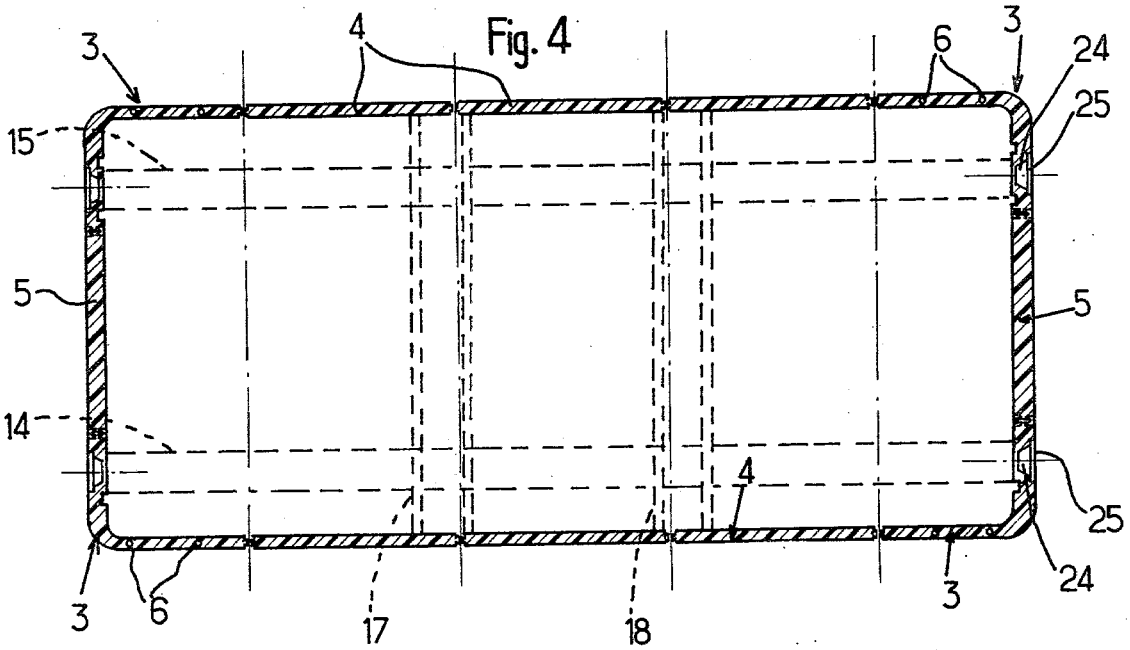
FIG. 4 is a horizontal section along line IV—IV of FIG. 3.
Figure 5:
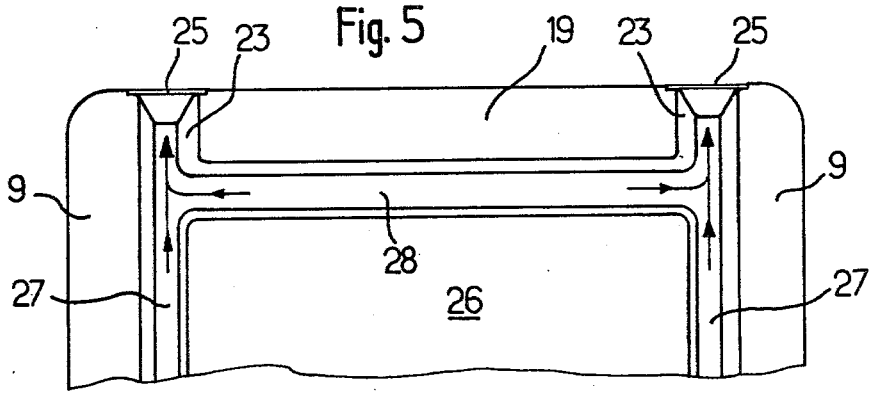
FIG. 5 is a partial plan view, on a larger scale, of the end part of the roof.
Figure 6:
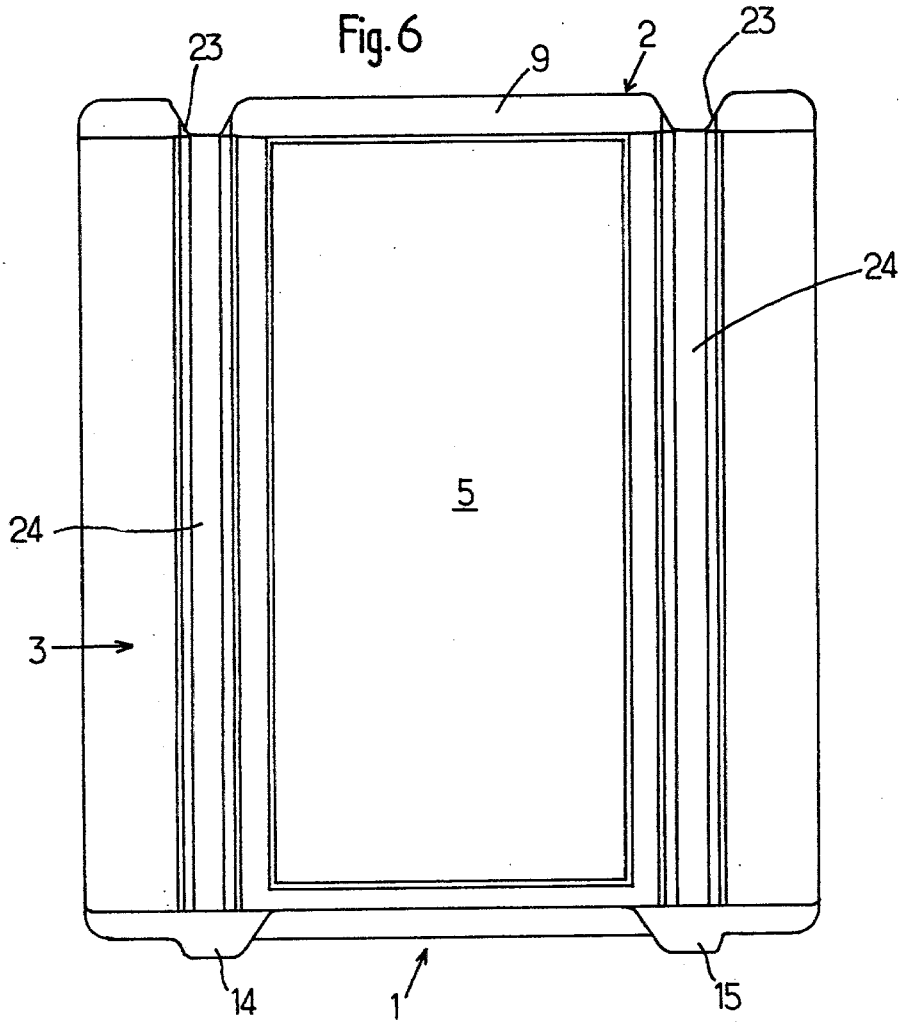
FIG. 6 is a view in elevation of an end of the building according to the invention.

Referring now to the drawings, FIGS. 1, 3 and 4 show the prefabricated building according to the invention, which comprises a floor 1 and a roof 2, of generally rectangular form, which are assembled together by means of four vertical corner elements 3, so as to form a substantially parallelepipedic structure. The side and front faces of the building are closed respectively by long-side panels 4 and end panels 5 which extend between the corner elements 3.

According to one of the features of the invention, the floor 1 and roof 2 are joined together, in the four corners of the building, by means of vertical ties 6, constituted for example by cables, which extend in vertical passages 7 made in the wall of the corner element 3, and the length of which is greater than the height of this corner element, so much so that each tie 6 projects at each end of said latter. At its upper end, the tie 6 is provided with a head **6*a* which is embedded and anchored in a hole 8 provided in a rib 9 or 19 of the roof 2, as will be seen hereinafter. This head 6*a* may be in the form of a wedge as shown in the drawing, or a hook gripping on a rod extending across the hole 8**.

In its lower part, the vertical tie 6 is provided with a threaded portion **6*b* which is engaged in a vertical passage 11 made in the border 12 of the floor 1 and on which a tensioning nut 13** is screwed.

The floor 1 and the roof 2 are assembled with the corner elements 3, the long-side panels 4 and the end panels 5 by the interlocking of ribs provided on the horizontal edges of the vertical elements, and corresponding grooves provided along the periphery of the floor 1 and roof 2.

All the elements constituting the building according to the invention are advantageously made of moulded plastic material.

Figure 2:
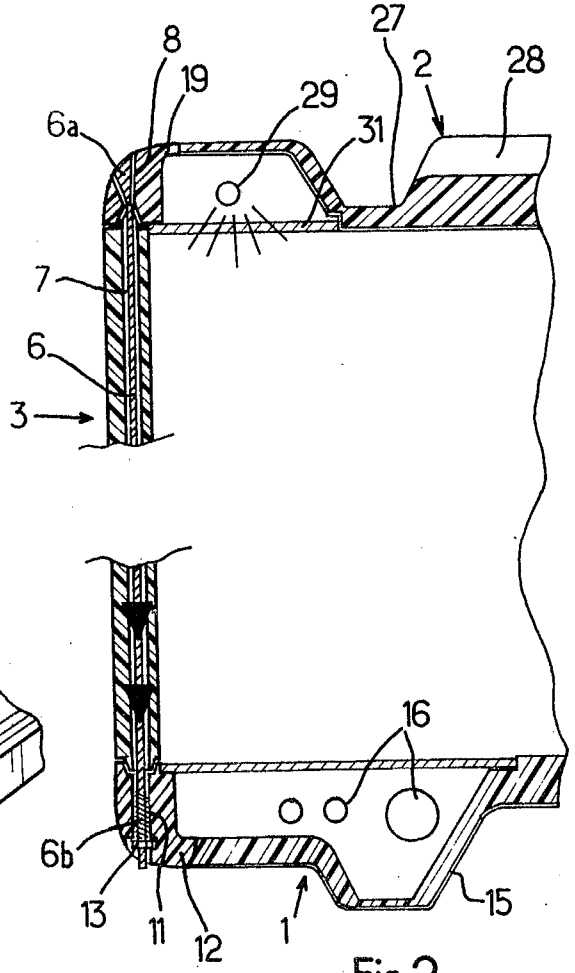
FIG. 2 is a partial vertical and longitudinal section along line II—II of FIG. 1.

The floor 1 is moulded in one piece with two lower longitudinal members 14, 15, also called "skids", which serve to take up the stresses during shifting and transport of the building. These skids 14, 15 are in fact constituted by lower longitudinal ribs extending over the whole length of the floor 1, and on the inside, as may be seen in FIG. 2, various fluid admission and evacuation pipes 16 may be housed inside the skid.

In the body of the floor 1 are also provided two transverse tunnels 17, 18 open to the outside and allowing the handling of the building by means of a fork-lift truck, the respective prongs of which may engage in the tunnels 17 and 18.

The roof 2 which is also moulded in one piece, in rectangular form, comprises on its periphery two longitudinal ribs 9 and two transverse ribs 19, located at right angles to the sub-jacent vertical panels, these latter ribs defining with each other, in the central part of the roof, a recessed zone forming collector for rain water.

To ensure the evacuation of the rain water thus collected, channels may be provided in the peripheral ribs of the roof 2, which channels are connected to vertical guttering incorporated in the outer surface of the corner elements 3. These channels 23 which are made at the ends of the transverse ribs 19, thus open out at right angles to vertical guttering 24 formed in the actual body of each corner element 3, on the transverse face thereof.

The vertical guttering 24 may be left open towards the outside or may be covered with a vertical plate 25 thus defining a drainpipe for the rain water.

The central part of the roof 2 which is defined between the peripheral ribs may be totally flat or may have a central zone 26 which projects slightly but not exceeding the height of the peripheral ribs 9, 19. This central zone 26 may have two surfaces regularly inclined from the centre towards the gable panels 5 in order to promote to flow of the rain water. This slightly projecting central zone thus defines with the peripheral ribs longitudinal and transverse grooves 27 and 28 respectively, collecting the rain water and conducting it to the channels 23. Inside the longitudinal and transverse ribs 9 and 19 respectively, illuminating tubes 29 (FIG. 2) may be housed, separated from the interior by transparent sheets 31.

The long-side panels 4 and end panels 5 are made in modular form; they have the same width and the same height. Like the roof and floor, they are made of moulded plastic material.

Figure 7:
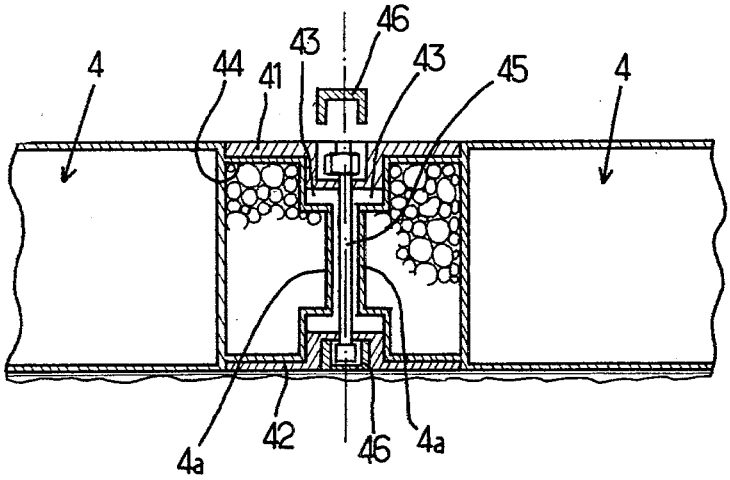
FIG. 7 is a section through the joint of two panels.

The manner in which two adjacent long-side panels are assembled together will now be described with reference to FIG. 7.

The system of assembly comprises two sections 41, 42, for example made of aluminium, of substantially omega cross-section. In other words, they have a central U-portion extending laterally in opposite directions by two outer flanges.

Each of the sections 41, 42 is so placed that the central U-portion is engaged in two opposite rabbets 43, essentially made in the edges of the panels 4, and that the two side flanges of the section are placed in two other rabbets 44 of smaller depth than the rabbets 43 and extending essentially in the front faces of the panels 4.

The two panels are then assembled together by securing the two sections 41, 42—by means of securing members such as screws 45 extending between the two opposite vertical edges 4*a* of the two panels. The screw or bolt 45 passes through the holes made in the central U-portions of the two sections 41, 42. The head of the screw or bolt and the nut are then concealed by clips 46 which avoid any disconnection of the outer and inner bare parts of the panels at right angles to the joints.

A glass fibre cover is added at right angles to each assembling device, when the outer and inner rough rendering is made, to conceal the joints.

What I claim is:

1. A prefabricated modular building, generally parallelepipedic in form, comprising a roof made of moulded plastic material, a floor and vertical panels, means for assembling these various elements together, four vertical corner elements placed respectively at the four corners of the building, extending over the whole height of the vertical panels, having vertical guttering channels in the outer surface thereof, and relatively positioning the roof and the floor, and vertical securing members anchored, at one of their ends, in one of the horizontal elements (roof or floor), passing through each corner element and tensioned and held, at their other ends, in the other horizontal element (floor or roof), the floor being formed in one piece with two lower longitudinal members forming skids constituting lower longitudinal ribs, which are upwardly open and suitable for housing pipes and with two transverse tunnels formed during moulding and allowing the building to be handled by means of a fork-lift truck, and the roof, moulded in one piece in rectangular form, comprising on its periphery two longitudinal ribs and two transverse ribs defining with each other, inwardly thereof, a recessed zone forming a collector for rain water and having channels arranged at the ends of the transverse ribs for the evacuation of the rain water and opening out and leading at right angles into said vertical guttering channels of said corner elements.

2. A building as claimed in claim 1, wherein each vertical securing member is constituted by a cable provided at one of its ends which has a head embedded in a hole in one of the horizontal elements (roof or floor) and provided at its other end with a threaded rigid extension on which a tightening nut is screwed, this threaded extension passing through a vertical passage made in the other horizontal element (floor or roof).

3. A building as claimed in claim 1, wherein the corner elements, the long-side panels and the end panels are provided, on their horizintal edges, with ribs fitting in corresponding grooves provided along the periphery of the floor and the roof.

4. A building as claimed in claim 1, wherein the vertical guttering formed in the wall of each corner element is covered by a vertical plate thus defining a drain pipe for the rain water.

5. A building as claimed in claim 1, wherein the central portion of the roof is slightly projecting without, however, exceeding the height of the peripheral ribs, this central portion defining, with the peripheral ribs, longitudinal and transverse grooves collecting the rain water to conduct it to the channels.

6. A building as claimed in claim 1, wherein the panels are assembled together by securing two pieces, placed on either side of the two assembled panels, by means of fastening members, each said piece having an omega cross-section and comprising a central U-shaped portion adapted to engage in a groove formed by two adjacent rabbets of two panels to be assembled, this central portion being extended in opposite directions by two side flanges, these flanges abutting on the marginal parts of the two adjacent panels.

7. A building as claimed in claim 6, wherein additional rabbets are provided in said panels and wherein said flanges of said pieces of omega cross-section are housed in said additional rabbets.

8. A building as claimed in claim 1, wherein clips are engaged in the central U-shaped portions f the sections to conceal the ends of the securing members.

* * * * *